US008651114B2

(12) United States Patent
Sieredziński et al.

(10) Patent No.: US 8,651,114 B2
(45) Date of Patent: Feb. 18, 2014

(54) METHOD AND ASSEMBLY FOR OPENING CIGARETTE WRAPPERS IN A MACHINE FOR RECOVERING TOBACCO FROM DEFECTIVE AND OR SUBSTANDARD CIGARETTES

(75) Inventors: Marek Sieredziński, Radom (PL); Wojciech Jerzy Chojnacki, Radom (PL)

(73) Assignee: International Tobacco Machinery Poland Sp. Z.O.O., Radom (PL)

( * ) Notice: Subject to any disclaimer, the term of this patent is extended or adjusted under 35 U.S.C. 154(b) by 563 days.

(21) Appl. No.: 12/870,396

(22) Filed: Aug. 27, 2010

(65) Prior Publication Data

US 2011/0220129 A1 Sep. 15, 2011

(30) Foreign Application Priority Data

Mar. 11, 2010 (PL) ..... 390677

(51) Int. Cl.
*A24C 1/04* (2006.01)

(52) U.S. Cl.
USPC ..... 131/96; 83/149

(58) Field of Classification Search
USPC ..... 131/96; 83/56, 861–887, 149, 438, 443, 83/444, 448–450
See application file for complete search history.

(56) References Cited

U.S. PATENT DOCUMENTS

| | | | | |
|---|---|---|---|---|
| 3,255,762 | A * | 6/1966 | Baier | 131/96 |
| 3,366,125 | A * | 1/1968 | Jackson | 131/96 |
| 3,665,931 | A * | 5/1972 | Mizzau | 131/280 |
| 4,041,822 | A * | 8/1977 | Gabel | 83/409.2 |
| 4,499,362 | A * | 2/1985 | Martin | 219/121.61 |
| 5,318,048 | A * | 6/1994 | Stewart et al. | 131/96 |
| 5,402,893 | A | 4/1995 | Keller | |
| 2009/0178688 | A1* | 7/2009 | Sieredzinski | 131/281 |

FOREIGN PATENT DOCUMENTS

| | | |
|---|---|---|
| EP | 0436304 | 7/1991 |
| GB | 325705 A | 2/1930 |
| GB | 357970 | 9/1931 |
| GB | 419971 | 11/1934 |
| GB | 1088002 A | 10/1967 |
| JP | 43-023982 | 10/1943 |
| PL | 174406 B1 | 1/1995 |

OTHER PUBLICATIONS

Chinese Notification of the First Office Action for Chinese Appln. No. 201010256965.9 dated Apr. 2, 2013.

Search Report issued by the Urzad Patentowy Rzeczypospolitej Polskiej (Patent Office of the Republic of Poland) in the corresponding Polish patent application P-390677, May 31, 2010.

* cited by examiner

*Primary Examiner* — Richard Crispino
*Assistant Examiner* — Yana Belyaev
(74) *Attorney, Agent, or Firm* — Browdy and Neimark, PLLC

(57) ABSTRACT

Method of opening a cigarette wrapper including cutting open a cigarette transported in a guiding groove of a feeder of a machine for recovering tobacco from defective and/or substandard cigarettes with at least one revolving disc knife located above the feeder, in which the at least one revolving disc knife is applied to the cigarette in such a way that the axis of rotation on which the said disc knife is perpendicularly mounted lies on a plane parallel to the plane over which the cigarette axis is translated, and the plane of the disc knife does not contain the cigarette axis and is parallel to the said cigarette axis, the possibility of rotation of the cigarette around its axis in the guiding groove is blocked, whereby tensile stress is applied in the cigarette wrapper facilitating its opening. Assembly for applying the method according to the invention.

9 Claims, 6 Drawing Sheets

METHOD AND ASSEMBLY FOR OPENING CIGARETTE WRAPPERS IN A MACHINE FOR RECOVERING TOBACCO FROM DEFECTIVE AND OR SUBSTANDARD CIGARETTES

FIELD OF THE INVENTION

The present invention concerns the domain of cigarette production, in particular recovering tobacco from defective and/or substandard cigarettes.

The object of the invention is the method and assembly for opening cigarette wrappers in a machine for recovering tobacco from defective and/or substandard cigarettes.

Rotating disc knives are used in the machines for recovering tobacco from cigarettes in order to cut or perforate the paper wrapper of the cigarettes. After the paper wrapper has been cut it must be separated from the tobacco along with all the chips or components of the filtering material.

In the case of cutting non-filter cigarettes, the paper wrapper is cut along the whole length of a cigarette. In the case of filter cigarettes, the paper wrapper should only be cut along the tobacco portion, while the filter portion paper wrapper covering the filter must remain unimpaired. Recycled tobacco is added to shredded tobacco fed to cigarette making machines. The quality of cigarettes is significantly lowered if the tobacco used for the production contains particles of filtering material, since the smoke from the burnt filtering material can be harmful to a smoker. Currently produced cigarettes are provided with multi segment filters containing filtering materials of various types. Materials in the form of granules are also used, e.g. activated carbon enclosed in a multi segment filter between other fragments, such as for example acetate filter, which form a chamber for loose material. Cutting such a filter is particularly disadvantageous since separation of granules which are significantly smaller than tobacco shreds requires application of special cleaning assemblies.

Considering the above reasons it is important that the cut paper wrapper of the recyclable cigarettes is easily and effectively separable from the remaining components of a cigarette.

STATE OF THE ART

Known devices for cutting cigarette paper wrapper were disclosed for example in the document U.S. Pat. No. 3,665,931.

In the known devices, e.g. according to U.S. Pat. No. 3,665,931, cigarettes are delivered by a feeder to a first linear vibrating conveyor, and then, after having been oriented parallel to the conveying direction, they are conveyed by a second linear vibrating conveyor belt towards a damping assembly and a cutting assembly. In the cutting assembly, a disc knife provided with a plurality of small blades is placed above every flute, the knife cutting the wetted cigarettes lengthwise. The cigarettes with perforated paper wrapper fall on a vibrating conveyor, where a part of tobacco is separated, and then they are fed to a so called "opener" assembly, where the pre-cut paper wrappers pass between revolving rollers provided with a plurality of perpendicularly oriented rods, causing the rest of the tobacco to be removed. During all these operations the tobacco from the cigarette is separated from the paper wrappers. The distance between the knife and the vibrating conveyor belt is adjusted in such way, that the wrapper covering the filter tip is not cut.

A disadvantage of the known devices is the separation of the cut paper wrappers from the tobacco. The "opener" assembly described in U.S. Pat. No. 3,665,931 has been specially designed for this purpose and it is indispensable because the paper wrappers that were pre-cut but have not been sufficiently open still constitute an important obstacle against their separation from the tobacco.

To solve the aforementioned problem of the prior art, a method and an assembly were designed enabling effective separation of the cut open paper wrappers and all the remaining parts or components of the filtering material from the tobacco which may then be recovered.

SUMMARY OF THE INVENTION

The method and the assembly according to the invention are based on a concept of generating torques to oppose the torques acting on the cigarette being cut open and generated as a result of the pressure applied by a rotating disc knife. Both the torque generated by the pressing force and the torque counteracting thereto act in a plane that is perpendicular to the axis of the cigarette being cut. Their action results in tensile stress being applied on the cigarette wrapper which facilitates its opening immediately upon cutting or perforation.

Method of opening a cigarette wrapper according to the invention includes cutting open the cigarette transported in a guiding groove of a feeder of a machine for recovering tobacco from defective and/or substandard cigarettes, the cigarette being cut with at least one revolving disc knife located above the feeder, in which:

the at least one revolving disc knife is applied to the cigarette in such a way that the axis of rotation on which the said disc knife is perpendicularly mounted lies on a plane parallel to the plane over which the cigarette axis is translated; and the plane of the disc knife does not comprise the cigarette axis and is parallel to the said cigarette axis;

the possibility of rotation of the cigarette around its axis in the guiding groove is blocked;

whereby tensile stress is being applied in the cigarette wrapper facilitating its opening.

Preferably, the possibility of rotation of the cigarette around its axis in the guiding groove is blocked by employing sufficient friction between the cigarette and the surface of the guiding groove.

Preferably, the shape of the guiding groove cross-section is asymmetrical in relation to the plane in which the cigarette axis is comprised, the friction coefficient between the cigarette and the surface of the guiding groove being lower on that side of the said plane where the disc knife is located than on the opposite side thereof.

The possibility of rotation of the cigarette around its axis in the guiding groove is preferably being blocked by an idly revolving element that is independent on the disc knife, said element pressing the cigarette against the inner surface of the guiding groove, and the axis of rotation of the said element being preferably parallel to the disc knife axis.

The possibility of rotation of the cigarette around its axis in the guiding groove may also be blocked by a second disc knife located on the opposite side of the cigarette axis.

According to another embodiment, the method of opening a cigarette wrapper of the invention includes cutting open the cigarette transported in a guiding groove of a feeder of a machine for recovering tobacco from defective and/or substandard cigarettes, the cigarette being cut with at least one revolving disc knife located above the feeder, in which:

the at least one revolving disc knife is applied to the cigarette in such a way that the axis of rotation on which the said disc knife is mounted slantwise in relation to the cigarette axis lies on a plane parallel to the plane over which the cigarette axis is translated;

rotation of the cigarette around its axis in the guiding groove is blocked;

whereby variable tensile stress is applied in the cigarette wrapper facilitating its opening.

Preferably, the rotation of the cigarette around its axis in the guiding groove is blocked by employing sufficient friction between the cigarette and the surface of the guiding groove.

According to yet another embodiment, the method of opening a cigarette wrapper includes cutting open the cigarette transported in a guiding groove of a feeder of a machine for recovering tobacco from defective and/or substandard cigarettes, the cigarette being cut with at least one revolving disc knife located above the feeder, in which:

the at least one revolving disc knife is applied to the cigarette in such a way that the axis of rotation on which the said disc knife is perpendicularly mounted lies on a plane parallel to the plane over which the cigarette axis is translated, the cigarette axis moving in the guiding groove along a sine curve;

the possibility of rotation of the cigarette around its axis in the guiding groove is blocked;

whereby variable tensile stress is applied in the cigarette wrapper facilitating its opening.

Preferably, the rotation of the cigarette around its axis in the guiding groove is blocked by employing sufficient friction between the cigarette and the surface of the guiding groove.

Preferably, a guiding groove is used having alternating protrusions on its opposite sides forming a sine curve shaped path.

According to a next embodiment, the method of opening a cigarette wrapper includes cutting open the cigarette transported in a guiding groove of a feeder of a machine for recovering tobacco from defective and/or substandard cigarettes, the cigarette being cut with at least one revolving disc knife located above the feeder, in which:

the at least one revolving disc knife is applied to the cigarette in such a way that the geometrical axis of the said disc is slanted in relation to the axis of rotation of the said disc, the said axis of rotation lying on a plane parallel to the plane over which the cigarette axis is translated;

the possibility of rotation of the cigarette around its axis in the guiding groove is blocked;

whereby variable tensile stress is applied in the cigarette wrapper facilitating its opening.

The rotation of the cigarette around its axis in the guiding groove may be blocked by employing sufficient friction between the cigarette and the surface of the guiding groove.

The assembly according to the invention for opening cigarette wrappers in a machine for recovering tobacco from defective and/or substandard cigarettes in which the cigarettes are translated to be cut along guiding grooves and at least one revolving disc knife is provided above each cigarette, each axis of rotation on which a disc knife is mounted lying on a plane parallel to the plane over which the cigarette axes move, is characterized in that the plane of at least one disc knife does not comprise the axis of the cigarette and is parallel to the said cigarette axis and in that the assembly is provided with means for blocking the possibility of rotation of the cigarettes around their axes in the guiding grooves.

The rotation blocking means may preferably comprise the guiding grooves surfaces having sufficiently increased friction coefficient of the pair—material of the groove surface and the cigarette wrapper.

The rotation blocking means may preferably comprise the guiding groove cross-section being asymmetrical in relation to the plane on which the cigarette axis is comprised, the friction coefficient between the cigarette and the surface of the guiding groove being lower on that side of the said plane where the disc knife is located than on the opposite side thereof.

Also preferably, the blocking means comprise a pressing element that is independent on the disc knife which presses the cigarette being cut against the inner surface of the guiding groove.

The pressing element is preferably an idly revolving pressure ring mounted on an axis which is preferably parallel to the disc knife axis.

The blocking means preferably comprise a second disc knife located on the opposite side of the cigarette axis.

According to another embodiment of the invention, the assembly for opening cigarette wrappers in a machine for recovering tobacco from defective and/or substandard cigarettes in which the cigarettes are translated along guiding grooves and at least one revolving disc knife is provided above each cigarette, each axis of rotation on which a disc knife is mounted lying on a plane parallel to the plane over which the cigarette axis move, is characterized in that at least one disc knife is mounted on its axis of rotation so that its plane is slanted in relation to the cigarette axes and in that the assembly is provided with means for blocking the possibility of rotation of the cigarettes around their axes in the guiding grooves.

Preferably, the blocking means comprise the guiding grooves surfaces having sufficiently increased friction coefficient between the groove surface and the cigarette wrapper.

According to a next embodiment, the assembly for opening cigarette wrappers in a machine for recovering tobacco from defective and/or substandard cigarettes in which the cigarettes are translated along guiding grooves and at least one revolving disc knife being provided above each cigarette, each axis of rotation on which a disc knife is mounted lying on a plane parallel to the plane over which the cigarette axes move, is characterized in that the axes of the cigarettes move in their guiding grooves along sine curves and in that the assembly is provided with means for blocking the possibility of rotation of the cigarettes around their axes in the guiding grooves.

Preferably, the blocking means comprise the guiding grooves surfaces having sufficiently increased friction coefficient between the groove surface and the cigarette wrapper.

The rotation blocking means preferably comprise the guiding grooves having alternating protrusions on their opposite sides forming a sine curve shaped path.

According to yet another embodiment, the assembly for opening cigarette wrappers in a machine for recovering tobacco from defective and/or substandard cigarettes in which the cigarettes are translated along guiding grooves and at least one revolving disc knife is provided above each cigarette, each axis of rotation on which a disc knife is mounted lying on a plane parallel to the plane over which the geometrical axis cigarette are translated, is characterized in that the geometrical axis of the said at least one disc is slanted in relation to the axis of rotation of the said disc and in that the assembly is provided with means for blocking possibility of rotation of the cigarettes around their axes in the guiding grooves.

Preferably, the blocking means comprise the guiding grooves surfaces having sufficiently increased friction coefficient between the groove surface and the cigarette wrapper.

The advantage of the invention is that it is based on a simple concept. The effectiveness of the inventive method results from the pressure of the perforating knives applied eccentrically in relation to the cigarette axis which in turn results in generation of a torque. It should be noted however, that if the cigarette were not constrained in any way, it would rotate. Opening of the perforated paper wrapper is a consequence of the cigarette rotation being prevented according to the invention by an element introducing the resistance that is opposed against the generated torque. Consequently, the structure of the cigarette wrapper which has been weakened by the knife teeth is being torn. The element introducing the resistance may be replaced by another torque opposing to the torque forcing the cigarette to rotate.

DESCRIPTION OF THE EXEMPLARY EMBODIMENTS

The assembly according to the invention for opening cigarette wrappers, in which the method according to the invention is carried out is shown schematically in the drawing in non-limiting exemplary embodiments, where:

FIG. 1 shows a perspective view of a machine for recovering tobacco provided with the assembly for opening cigarettes according to the invention;

FIG. 2*a* shows a perspective view of the assembly for opening cigarette wrappers according to the first embodiment of the invention;

FIG. 2*b* shows a partially sectional view of the assembly of FIG. 2*a;*

Figure 5A:
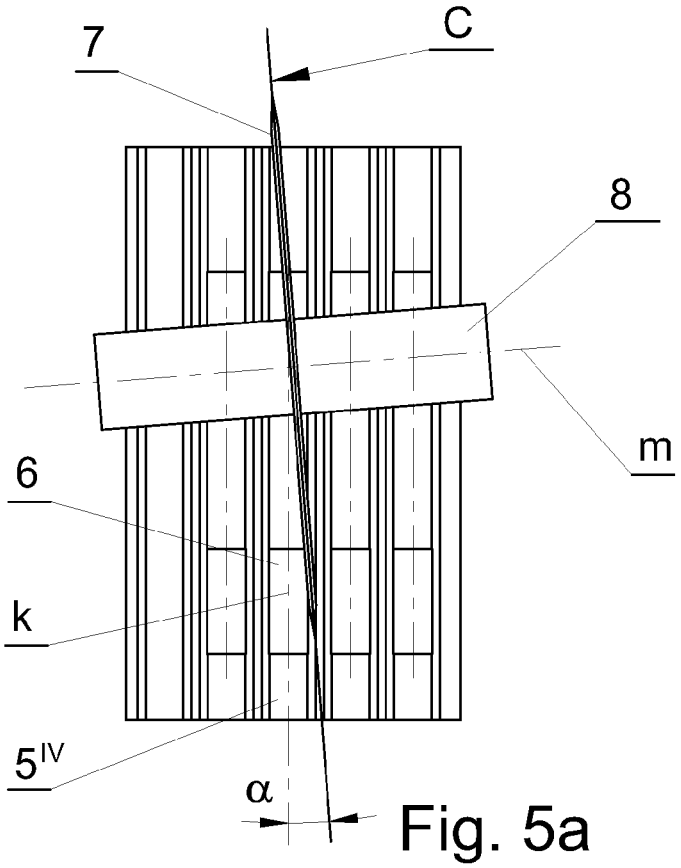
Figure 5B:
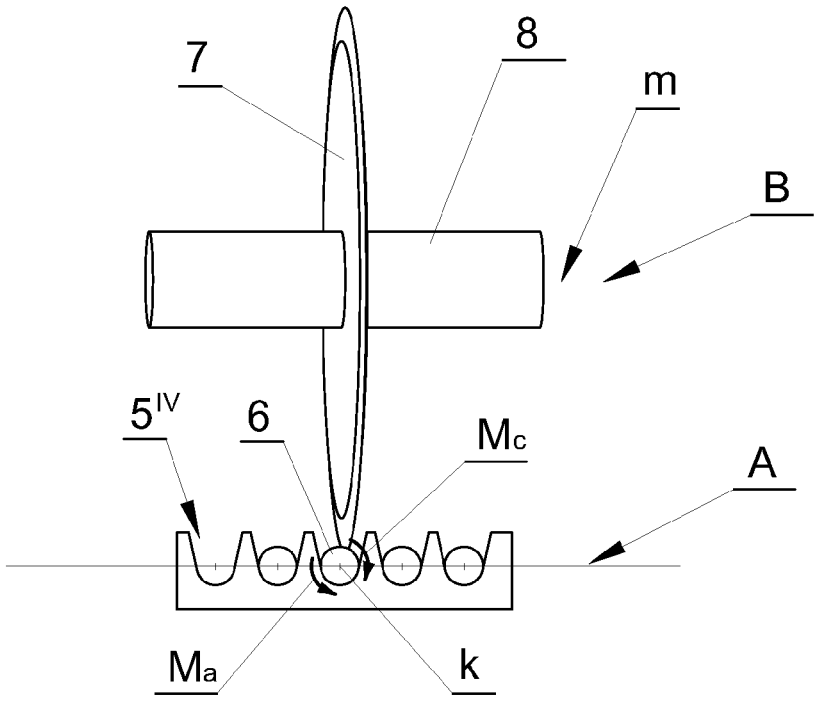

FIG. 5*a* shows a view from above of the assembly for opening cigarette wrappers according to the second embodiment of the invention;

FIG. 5*b* shows a partially sectional view of the assembly of FIG. 5*a;*

Figure 6A:
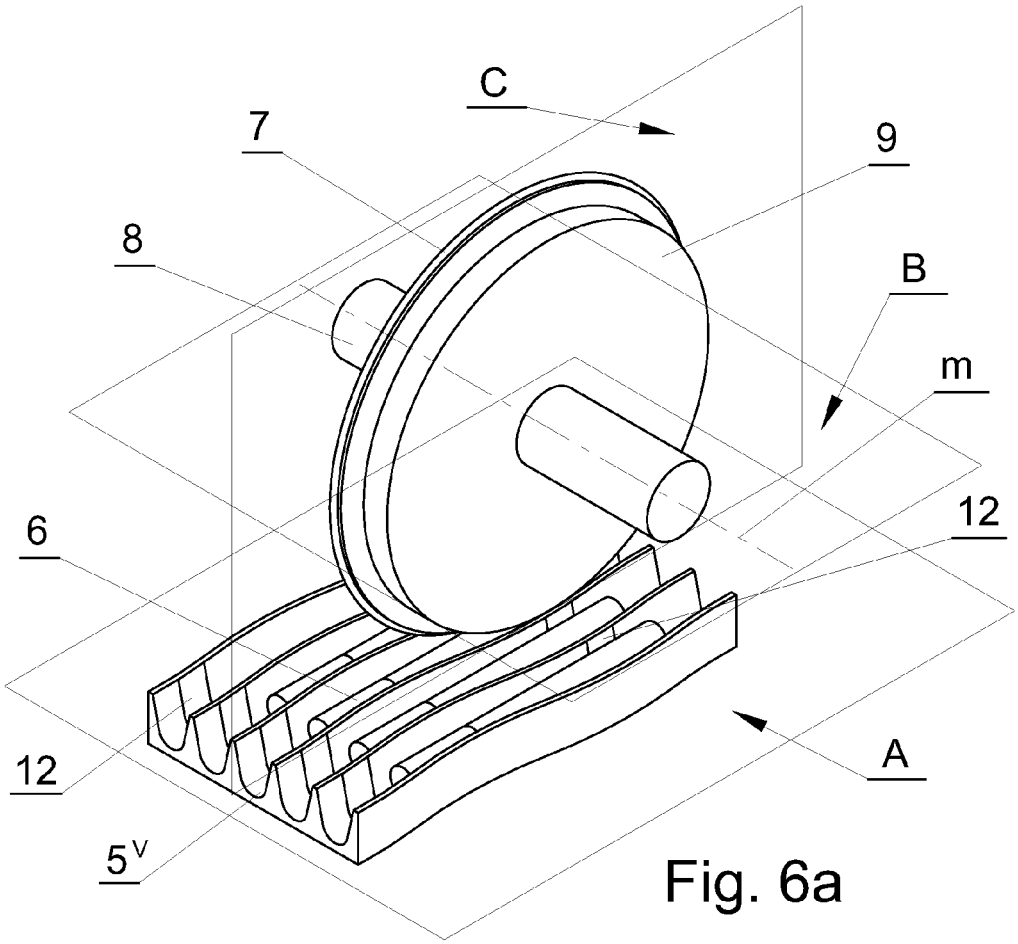
Figure 6B:
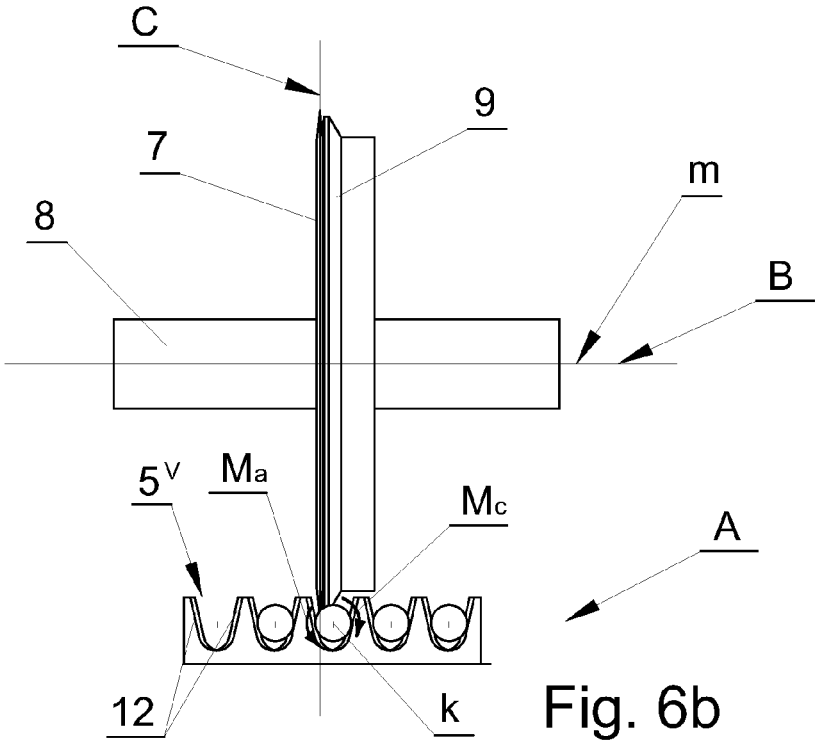

FIG. 6*a* shows a perspective view of the assembly for opening cigarette wrappers according to the third embodiment of the invention;

FIG. 6*b* shows a partially sectional view of the assembly of FIG. 6*a;*

Figure 7A:
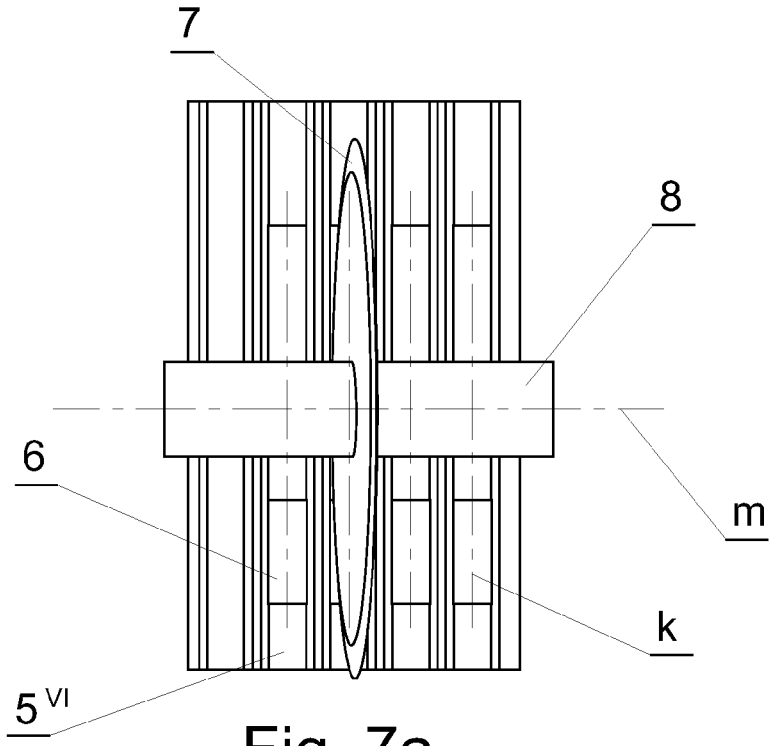
Figure 7B:
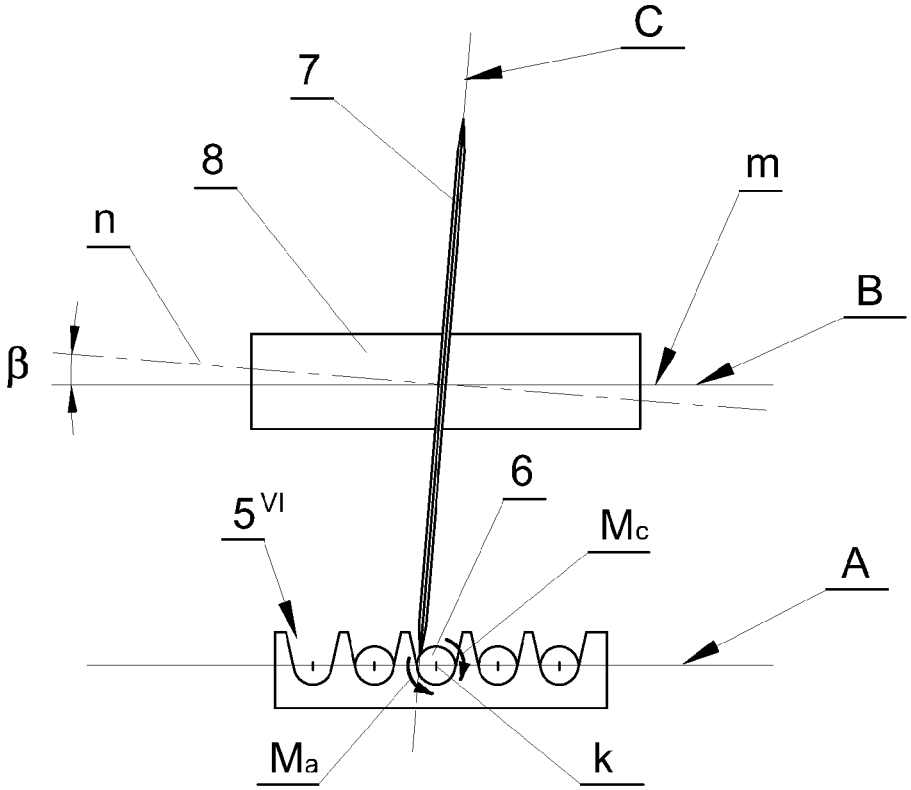

FIG. 7*a* shows a view from above of the assembly for opening cigarette wrappers according to the fourth embodiment of the invention;

FIG. 7*b* shows a partially sectional view of the assembly of FIG. 7*a.*

Figure 1:
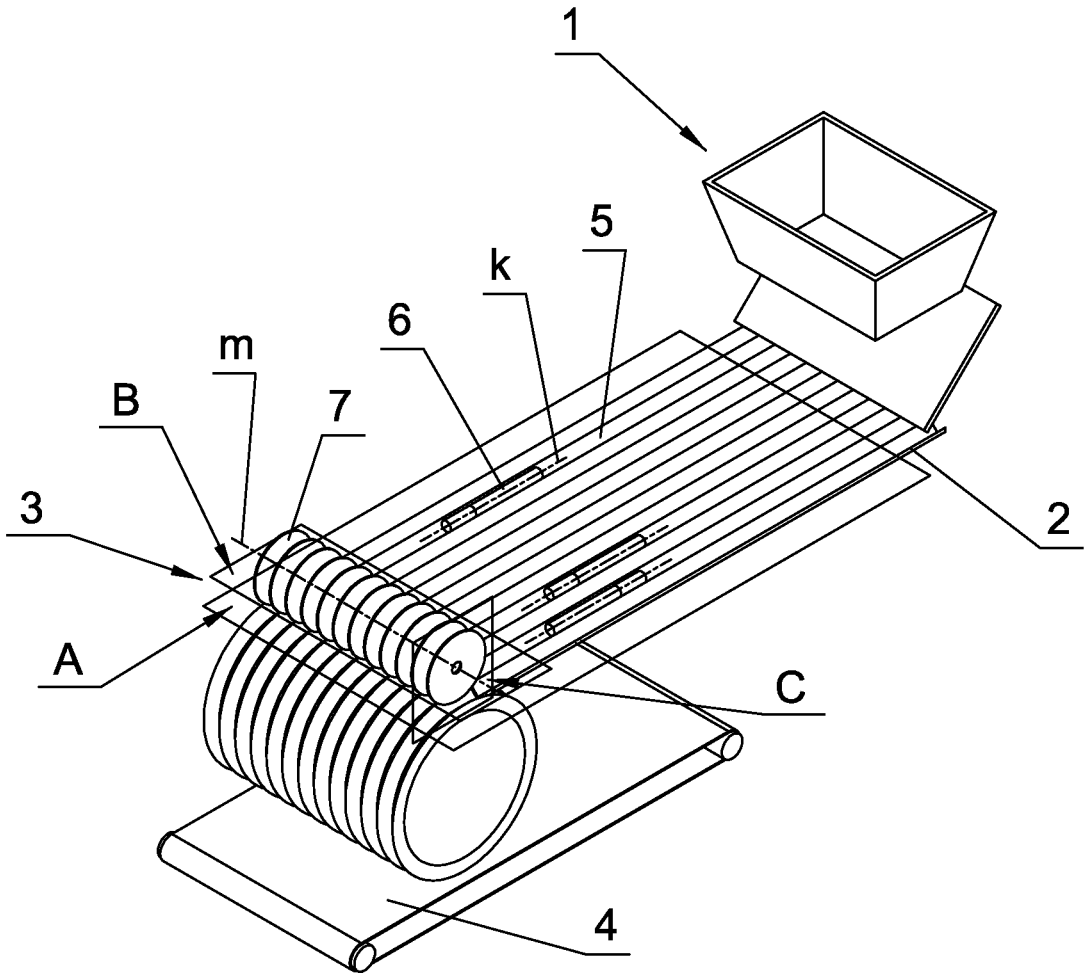

A machine for recovering tobacco shown in FIG. 1 comprises a loading assembly 1 for delivering defective and/or substandard cigarettes to a feeder 2 at the end of which there is located an assembly for opening cigarette wrappers 3. After passing through the opening assembly 3 which can be equipped with an additional feeder e.g. a drum or a linear feeder, the cigarettes fall down onto a receiving assembly 4 for receiving the cut open cigarettes. The receiving assembly has the form of a conveyor that transports the cigarettes to an assembly (not shown) for recovering tobacco from the cut open cigarettes. The feeder 2 may be equipped with longitudinal grooves 5 extending along the transport direction, the grooves aligning the cigarettes 6 in such a way that the axes k of the cigarettes 6 are positioned along the transport direction before being delivered to the opening assembly 3. The axes k of the cigarettes 6 being transported along the grooves 5 and before being delivered to the opening assembly 3 are positioned on a plane A. The opening assembly 3 may comprise a set of disc knives 7 mounted on a mutual axis m lying on a plane B located in parallel to the plane A. The cigarettes may be cut open while being transported along the grooves of a planar feeder, e.g. a band or drum feeder.

Figure 2A:
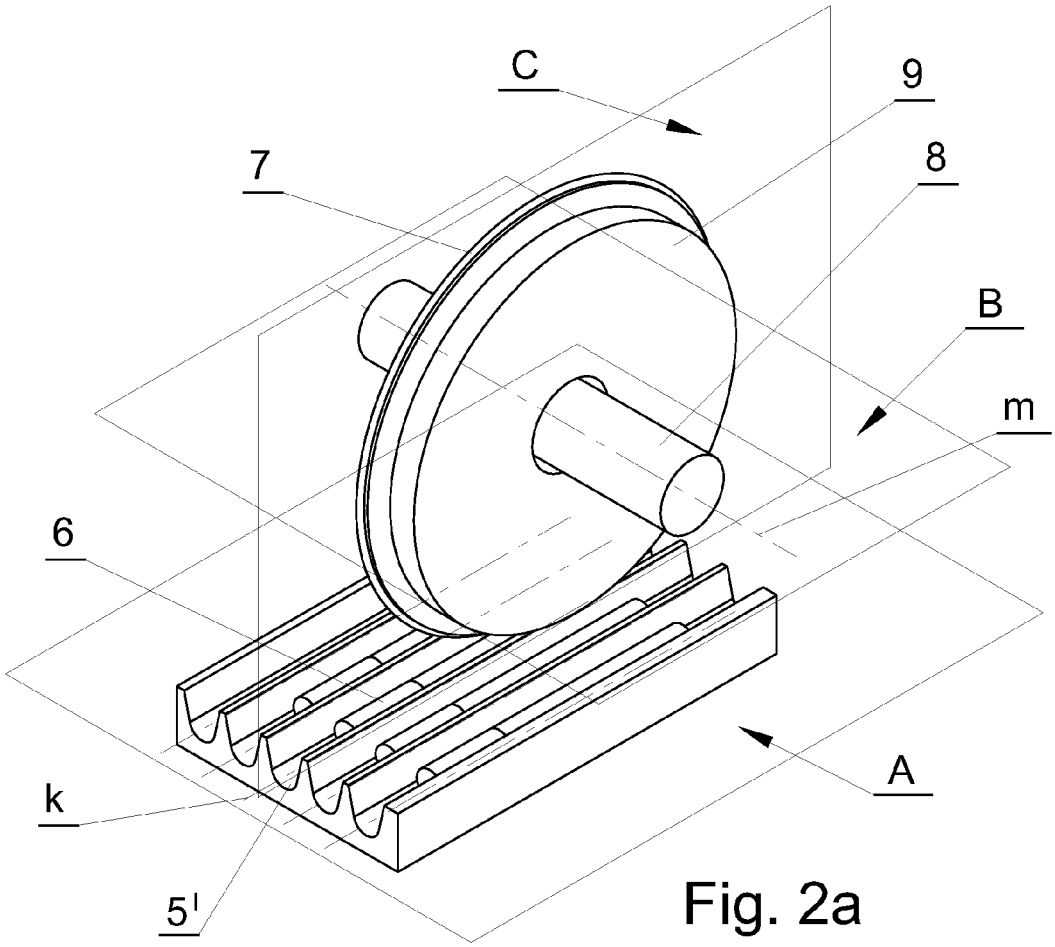
Figure 2B:
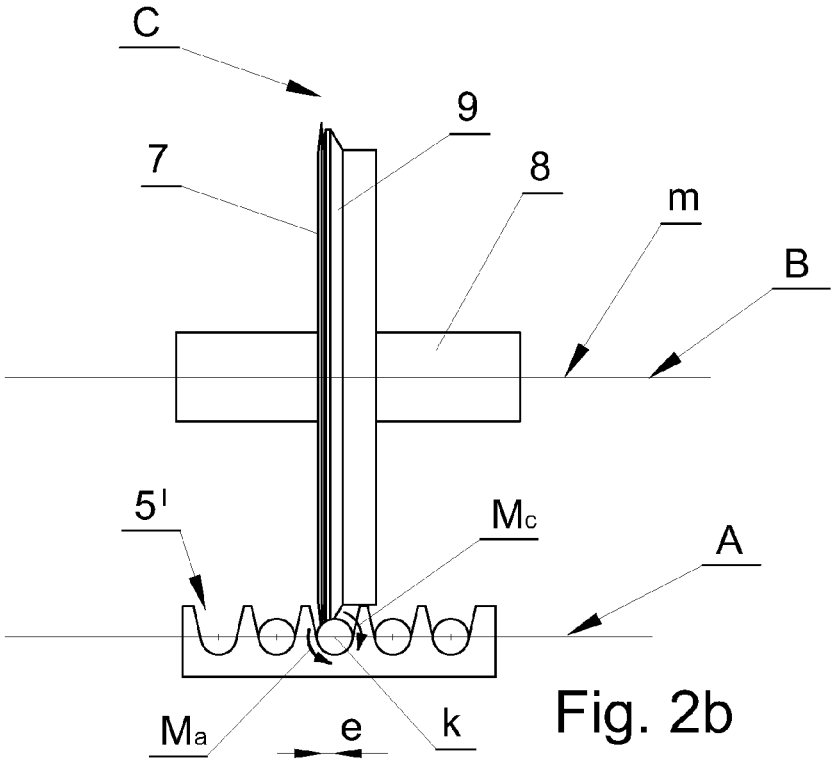

In the first embodiment of the assembly according to the invention shown in FIGS. 2*a* and 2*b*, a revolving disc knife 7 for opening the cigarettes is mounted on a shaft 8, the axis m of the knife 7 lying on the plane B which is parallel to the plane A on which the cigarette axes k are moving while the cigarettes 6 are being transported along the grooves 5' (FIG. 2*a*). The knife 7 lies on a plane C which is perpendicular to the plane A and to the axis m; the plane C does not comprise the cigarette axis k and is spaced from it by a distance e (FIG. 2*b*). In parallel to the plane C of the knife 7 there is situated a revolving pressure ring 9 which is idly mounted on an axis which is parallel to axis m of the disc knife 7.

During opening, the cigarette 6 is being transported under the knife 7. As a consequence of the pressure of the knife 7 exerted on the cigarette 6, a torque $M_a$ is generated, shown on FIG. 2*b*, acting on the cigarette over a plane that is perpendicular to its axis k. As the ring 9 exerts additional pressure on the cigarette 6 and considering that the friction coefficient between the guiding groove 5' surface and the cigarette wrapper is high, a torque $M_c$ being a friction torque is generated counteracting the torque $M_a$ and blocking the rotation of the cigarette 6.

Figure 3:
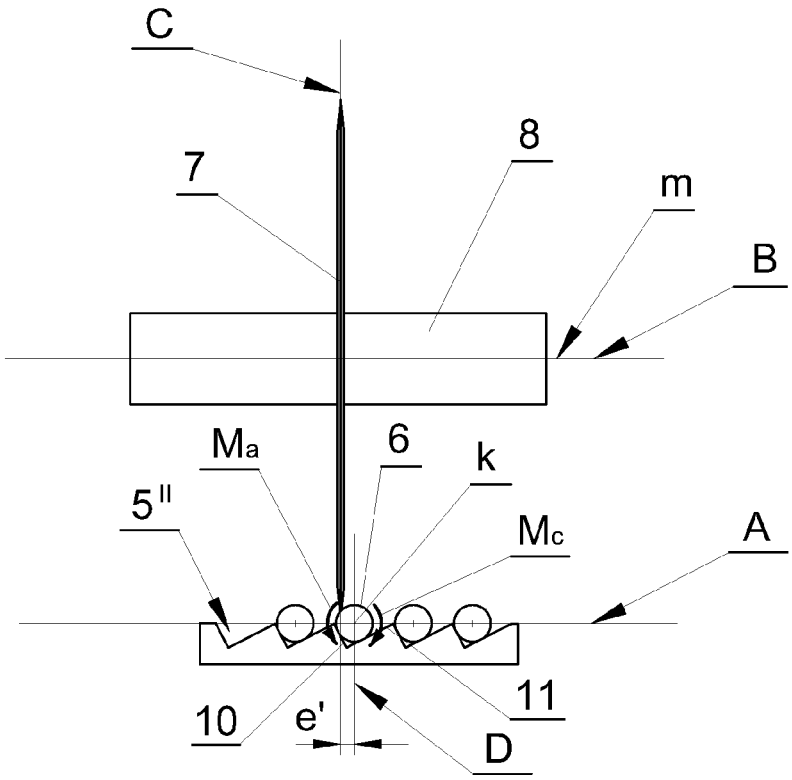
FIG. 3 shows a partially sectional view of the assembly having a guiding groove with an asymmetrical cross-section.

FIG. 3 shows a revolving disc knife 7 mounted on a shaft 8, its axis m lying on the plane B which is parallel to the plane A over which the cigarette axis k are moving while the cigarettes 6 are being transported along the grooves 5". The knife 7 lies on a plane C which is perpendicular to the plane A and to the axis m; the plane C does not comprise the cigarette axis k and is spaced from it by a distance e'. The groove 5" has two surfaces 10 and 11, each slanted in relation to the plane C. During opening, the cigarette 6 is being transported under the knife 7. As a consequence of the pressure of the knife 7 exerted on the cigarette 6, a torque $M_a$ is generated, acting on the cigarette over a plane that is perpendicular to its axis k. The surfaces 10 and 11 are arranged asymmetrically in relation to the plane D comprising the axis k of the cut cigarette 6. The friction coefficient between the cigarette wrapper and the surface 10 is lower than that between the cigarette wrapper and the surface 11. In consequence of the cigarette being pressed to the surface 10 of the groove 5", a torque $M_c$ being a friction torque is generated counteracting the torque $M_a$ and blocking the rotation of the cigarette 6.

Figure 4:
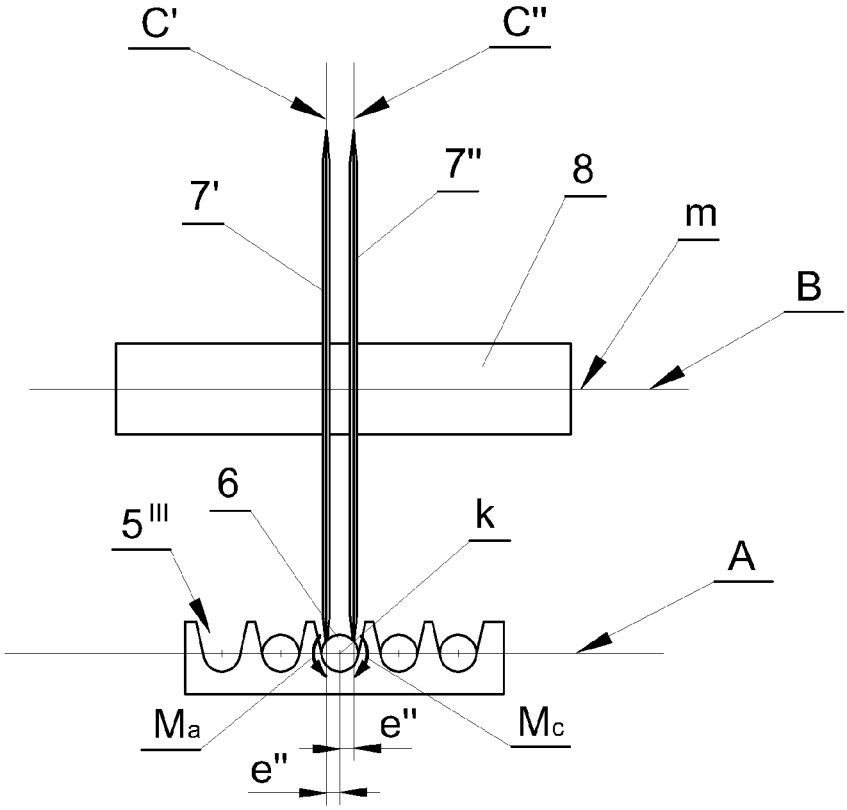
FIG. 4 shows a partially sectional view of the assembly provided with two disc knives.

FIG. 4 shows another embodiment of the assembly according to the invention where two revolving disc knifes 7' and 7" are mounted on a shaft 8, its axis lying on the plane B which is parallel to the plane A over which the cigarette axes k are moving while the cigarettes 6 are being transported. The knife 7' lies on a plane C' which is perpendicular to the plane A and parallel to the cigarette axis k and is spaced from it by a distance e". The knife 7" lies on a plane C" which is perpendicular to the plane A and parallel to the cigarette axis k and is spaced from it by a distance e" being equal to e', the plane C" being located on the opposite side of the cigarette axis k in relation to the plane C'. In consequence of the pressure of the knife 7', a torque $M_a$ is generated, acting on the cigarette 6 around its axis k and in consequence of the pressure of the knife 7", a torque $M_c$ is generated, acting on the cigarette 6 also around its axis k but in the opposite direction and counteracting the torque $M_a$, eliminating the possibility of rotation of the cigarette 6.

FIGS. 5*a* and 5*b* show the second embodiment of the opening assembly according to the invention, in which a revolving disc knife 7 is mounted on a shaft 8, its axis m lying on the plane B which is parallel to the plane A over which the cigarette axes k are moving and the plane C on which the disc knife 7 lies is slanted in relation to the axis of the cigarette being cut by an angle α. In the part of the cigarette moving along the groove $\mathbf{5}^{IV}$ being in contact with the disc knife 7 a torque $M_a$ is produced, the torque $M_a$ being locally variable along the line of contact of the knife and the cigarette. The torque $M_a$ acts on fragments of the cigarette, around the axis k. The rotation of the consecutive fragments of the cigarette is blocked by a sufficiently high friction coefficient between the surface of the groove $\mathbf{5}^{IV}$ and the cigarette wrapper. In consequence of the pressure of the knife 7 on the cigarette 6, a torque $M_c$ is produced which is a friction torque, being locally variable along the line of contact of the knife and the cigarette, and counteracting the torque $M_a$.

FIGS. 6*a* and 6*b* show the third embodiment of the opening assembly according to the invention, in which a revolving disc knife 7 is mounted on a shaft 8, its axis m lying on the plane B which is parallel to the plane A over which the cigarette axes k are moving along the grooves $\mathbf{5}^{V}$ having a sinusoidal shape. This type of groove shape may be obtained by provision of alternate inserts 12 on the opposite sides of each groove $\mathbf{5}^{V}$. With the position of the disc knife 7 plane C being fixed and the shape of the groove being sinusoidal, consecutive parts of the cut cigarette are being moved perpendicularly to its axis k and parallel to the plane A. In consequence, a locally variable torque $M_a$ is acting on the cigarette around its axis k. A properly selected sufficiently high friction coefficient between the surface of the groove and the cigarette wrapper ensures that a friction torque $M_c$ is produced in consequence of the cigarette 6 being pressed by the knife 7 to the inner surface of the groove $\mathbf{5}^{V}$, the friction torque $M_c$ counteracting the torque $M_a$. The rotation of the cigarette while cutting is thereby blocked.

FIGS. 7*a* and 7*b* show the fourth embodiment of the opening assembly according to the invention, in which the axis of the revolving disc knife 7 mounted on a shaft 8 lies in the plane B which is parallel to the plane A over which the cigarette axes k are moving. The geometrical axis n of the knife 7 is slanted in relation to the axis of rotation m by an angle β. In consequence of such a mutual arrangement of the knife 7 and the shaft 8, the line of contact of the knife 7 with the cigarette wrapper is not stable in relation to the cigarette axis k while the cigarette 6 is being transported in the groove $\mathbf{5}^{VI}$ and the knife is revolving. In fact this line of contact is oscillating in relation to the axis k, passing from one side thereof to the other and causing a variable torque $M_a$ to be produced and act on the cigarette 6 around its axis k.

During opening a cigarette, the cigarette 6 is constantly pressed by the knife to the inner surface of the groove $\mathbf{5}^{VI}$, having an appropriate friction coefficient of the pair—the material of the groove and the cigarette wrapper, which causes a torque $M_c$ to be produced, this torque $M_c$ being variable and depending on the oscillations and counteracting the torque $M_a$ in consequence of which the rotation of the cigarette is blocked.

The invention claimed is:

1. Assembly for opening cigarette wrappers in a machine for recovering tobacco from defective and/or substandard cigarettes, comprising:

guiding grooves having a surface along which cigarettes are translated and a height sufficient to accommodate the cigarettes, wherein axes of the cigarettes lie on a first imaginary plane;

at least one revolving disc knife mounted above each guiding groove so as to rotate about an axis of rotation, the axis of rotation lying on a second imaginary plane parallel to the first imaginary plane and the at least one revolving disc knife lying on a third imaginary plane perpendicular to the first and second imaginary planes, wherein the third imaginary plane of the at least one revolving disc knife is off-center of the guiding groove and is parallel to a fourth imaginary plane which is perpendicular to the first imaginary plane and passes through the axis of the cigarette in the guiding groove; and means for blocking rotation of the cigarettes around their axes in the guiding grooves comprising a sufficiently increased friction coefficient between the surface of the guiding grooves and the cigarette wrappers, the means for blocking rotation of the cigarettes around their axes in the guiding grooves generating torque whereby tensile stress is applied in the cigarette wrappers facilitating their opening.

2. Assembly according to claim 1, wherein the means for blocking rotation of the cigarettes around their axes in the guiding grooves further comprising the guiding grooves having a cross-section that is asymmetrical in relation to the fourth imaginary plane, the friction coefficient between the cigarettes and the surface of the guiding grooves is lower on a side of the surface of the guiding grooves where the at least one revolving disc knife is located than on an opposite side thereof.

3. Assembly for opening cigarette wrappers in a machine for recovering tobacco from defective and/or substandard cigarettes, comprising:

guiding grooves having a surface along which cigarettes are translated and a height sufficient to accommodate the cigarettes, wherein axes of the cigarettes lie on a first imaginary plane;

at least one revolving disc knife mounted above each guiding groove so as to rotate about an axis of rotation, the axis of rotation lying on a second imaginary plane parallel to the first imaginary plane and the at least one revolving disc knife lying on a third imaginary plane perpendicular to the first and second imaginary planes, wherein the third imaginary plane of the at least one revolving disc knife is off-center of the guiding groove and is parallel to a fourth imaginary plane which is perpendicular to the first imaginary plane and passes through the axis of the cigarette in the guiding groove; and means for blocking rotation of the cigarettes around their axes in the guiding grooves comprising a sufficiently increased friction coefficient between the surface of the guiding grooves and the cigarette wrappers, the means for blocking rotation of the cigarettes around their axes in the guiding grooves further comprising an independent pressing element on the at least one revolving disc knife which presses the cigarette being cut against the surface of the guiding groove, the means for blocking rotation of the cigarettes around their axes in the guiding grooves generating torque whereby tensile stress is applied in the cigarette wrappers facilitating their opening.

4. Assembly according to claim 3, wherein the pressing element is an idly revolving pressure ring mounted on an axis which is parallel to the axis of rotation.

5. Assembly for opening cigarette wrappers in a machine for recovering tobacco from defective and/or substandard cigarettes, comprising:

guiding grooves having a surface along which cigarettes are translated and a height sufficient to accommodate the cigarettes, wherein axes of the cigarettes lie on a first imaginary plane;

at least one revolving disc knife mounted above each guiding groove so as to rotate about an axis of rotation, the axis of rotation lying on a second imaginary plane parallel to the first imaginary plane and the at least one revolving disc knife lying on a third imaginary plane perpendicular to the first and second imaginary planes, wherein the third imaginary plane of the at least one revolving disc knife is off-center of the guiding groove and is parallel to a fourth imaginary plane which is perpendicular to the first imaginary plane and passes through the axis of the cigarette in the guiding groove; and means for blocking rotation of the cigarettes around their axes in the guiding grooves comprising a sufficiently increased friction coefficient between the surface of the guiding grooves and the cigarette wrappers and a second revolving disc knife mounted above the guiding groove on an opposite side of the fourth imaginary plane from the third imaginary plane, the means for blocking rotation of the cigarettes around their axes in the guiding grooves generating torque whereby tensile stress is applied in the cigarette wrappers facilitating their opening.

6. Assembly for opening cigarette wrappers in a machine for recovering tobacco from defective and/or substandard cigarettes, comprising:

guiding grooves having a surface along which cigarettes are translated and a height sufficient to accommodate the cigarettes, wherein axes of the cigarettes lie on a first imaginary plane;

at least one revolving disc knife mounted above each guiding groove so as to rotate about an axis of rotation, the axis of rotation lying on a second imaginary plane parallel to the first imaginary plane and the at least one revolving disc knife lying on a third imaginary plane perpendicular to the first and second imaginary planes, wherein the third imaginary plane of the at least one disc knife is at a non-right angle with respect to the axis of the cigarette in the guiding groove; and means for blocking rotation of the cigarettes around their axes in the guiding grooves comprising a sufficiently increased friction coefficient between the surface of the guiding grooves and the cigarette wrappers, the means for blocking rotation of the cigarettes around their axes in the guiding grooves generating torques whereby tensile stress is applied in the cigarette wrappers facilitating their opening.

7. Assembly for opening cigarette wrappers in a machine for recovering tobacco from defective and/or substandard cigarettes, comprising:

guiding grooves having a surface along which cigarettes are translated and a height sufficient to accommodate the cigarettes, wherein axes of the cigarettes lie on a first imaginary plane;

at least one revolving disc knife mounted above each guiding groove so as to rotate about an axis of rotation, the axis of rotation lying on a second imaginary plane parallel to the first imaginary plane and the at least one revolving disc knife lying on a third imaginary plane perpendicular to the first and second imaginary planes, wherein the cigarettes are driven to move in their guiding grooves such that the axes of the cigarettes move along sine curves; and means for blocking rotation of the cigarettes around their axes in the guiding grooves comprising a sufficiently increased friction coefficient between the surface of the guiding grooves and the cigarette wrappers, the means for blocking rotation of the cigarettes around their axes in the guiding grooves generating torque whereby tensile stress is applied in the cigarette wrappers facilitating their opening.

8. Assembly according to claim 7, wherein the guiding grooves have alternating protrusions on their opposite sides forming a sine curve shaped path.

9. Assembly for opening cigarette wrappers in a machine for recovering tobacco from defective and/or substandard cigarettes, comprising:

guiding grooves having a surface along which cigarettes are translated and a height sufficient to accommodate the cigarettes, wherein axes of the cigarettes lie on a first imaginary plane;

at least one revolving disc knife mounted above each guiding groove so as to rotate about an axis of rotation, the axis of rotation lying on a second imaginary plane parallel to the first imaginary plane and the at least one revolving disc knife lying on a third imaginary plane intersecting the first and second imaginary planes, wherein a geometrical axis of the at least one revolving disc knife is slanted in relation to the axis of rotation; and means for blocking rotation of the cigarettes around their axes in the guiding grooves comprising a sufficiently increased friction coefficient between the surface of the guiding grooves and the cigarette wrappers, the means for blocking rotation of the cigarettes around their axes in the guiding grooves generating torque whereby tensile stress is applied in the cigarette wrappers facilitating their opening.

* * * * *